US005699085A

United States Patent [19]

Takei et al.

[11] Patent Number: 5,699,085

[45] Date of Patent: Dec. 16, 1997

[54] DISPLAY DEVICE

[75] Inventors: Toshikazu Takei; Masao Saito, both of Kyoto, Japan

[73] Assignee: Rohm Co., Ltd., Kyoto, Japan

[21] Appl. No.: 984,674

[22] Filed: Dec. 2, 1992

[30] Foreign Application Priority Data

Dec. 3, 1991 [JP] Japan ..... HEI 3-348208

[51] Int. Cl.[6] ..... G09G 3/00

[52] U.S. Cl. ..... 345/185; 345/204; 345/211

[58] Field of Search ..... 340/762, 782, 340/811, 813, 799, 798, 750; 345/46, 82, 211, 212, 213, 185, 196, 197, 204

[56] References Cited

U.S. PATENT DOCUMENTS 4,278,974 7/1981 Kondo ..... 340/798
4,298,870 11/1981 Saegusa ..... 340/813
4,661,812 4/1987 Ikeda ..... 340/799
4,739,323 4/1988 Miesterfeld et al. ..... 340/825.5

FOREIGN PATENT DOCUMENTS 0080290 4/1991 Japan ..... 340/813

*Primary Examiner*—Richard Hjerpe
*Assistant Examiner*—Lun-Yi Lao
*Attorney, Agent, or Firm*—Brumbaugh, Graves, Donohue & Raymond

[57] ABSTRACT

The display device includes a plurality of display elements to be driven selectively or simultaneously; a storage unit for storing display data to be displayed by the display elements; a storage control unit for generating a display inhibition signal for a predetermined period of time from turning-on of a power supply till the display data of the storage unit is made definite; and a display driving control unit for breaking supply of a driving current to the display elements when the storage control unit is generating the display inhibition signal.

7 Claims, 7 Drawing Sheets

LED MODULE
2
DISPLAY DRIVING CIRCUIT
28
GR0
GR1
GR15
RD0
RD1
RD15
COM1
COM2
COM15
36 : DISPLAY DRIVING CONTROL CIRCUIT
EN
PRE-DRIVER
25
PRE-DRIVER
26
PRE-DRIVER
34
40
36
IP
CK

24
MEMORY CONTROL CIRCUIT
TIMING CONTROL CIRCUIT
CLOCK DETECTION CIRCUIT
30
38
16
DB
6
RAM
18
DB
14
AD
10
DB
4
RAM
12
DB
8
AD
15
SIR
17
SIR
32
SWITCH
FS
GR
Ad
RD

DISPLAY DEVICE

BACKGROUND OF THE INVENTION

The present invention relates to a display device for performing desired pattern display by use of various display elements, such as a fluorescent display tube, a plasma display, an LCD display, an LED display, and so Conventionally, a display device for displaying desired patterns such as characters or the like by use of a plurality of display elements constituted by LEDs or the like, includes a display control IC for controlling an LED module provided with LEDs arranged in a plurality of rows and columns, the display control IC being provided with two memories. For those memories, a method is employed so that display data is read from one of the memories while data is being written in the other memory so as to perform writing and reading alternately to thereby display the display data on the LED module.

In such a display device including two memories and driving one LED module, however, the stored data in the memory from which data is read initially is indefinite immediately after a power supply is turned on, so that also the contents of display of the LED module based on such data is put in an indefinite state.

Further, in case that such a display device is applied to, for example, various apparatuses including microcomputers using intrinsic frequencies different from each other, it is necessary to provide counters corresponding to the kinds of the frequencies in order to obtain frequencies necessary for controlling display. Accordingly, if the kinds of required frequencies are increased, there is a problem that the circuit size is increased, and also the number of gates is increased.

SUMMARY OF THE INVENTION

It is therefore an object of the present invention to provide a display device in which indefinite data immediately after turning-on of a power supply is prevented from being displayed.

Further, it is another object of the present invention to provide a display device in which desired frequencies can be selected from the outside in accordance with necessity.

The display device according to the present invention is characterized by comprising: a plurality of display elements to be driven selectively or simultaneously; a storage means for storing display data to be displayed by the display elements; a storage control means for generating a display inhibition signal for a predetermined period of time from turning-on of a power supply till the display data of the storage means is made definite; and a display driving control means for breaking supply of a driving current to the display elements when the storage control means is generating the display inhibition signal.

Further, the display device according to the present invention is characterized by comprising: a plurality of display elements to be driven selectively or simultaneously; a common signal generating means supplied with a clock signal for generating a plurality of different common signals for establishing current conduction periods for driving currents to be supplied to the display elements respectively; and a clock frequency changing means provided in a stage before the common signal generating means and supplied with the clock signal, for changing the frequency of the clock signal in response to an external clock selection signal and for supplying the clock signal having the changed frequency to the common signal generating means.

The storage control means generates a display inhibition signal for a predetermined period of time after turning-on of a power supply till the display data of the storage means is made definite. This display inhibition signal is supplied to a display driving control means, and in response to this display inhibition signal the display driving control means breaks supplying a driving current to display elements. Therefore, in this display device, display elements are inhibited from displaying after turning on the power supply till display data of the storage means is made definite, so that it is possible to prevent indefinite display, and it is possible to increase the reliability of display.

Further, according to the present invention, the current conduction periods for driving currents to be supplied to display elements are set by common signals, and these common signals are formed by a clock signal. Therefore, the frequency of this clock signal can be changed by an external selection signal, so that common signals can be generated from the clock signal of a desired frequency. It is therefore possible in this display device to form the common signals on the basis of the clock signal corresponding to a frequency of an application, so that it is possible to simplify the structure of the circuit.

DETAILED DESCRIPTION OF THE INVENTION

Preferred embodiments of the present invention will be described in detail with reference to the drawings.

Figure 1:
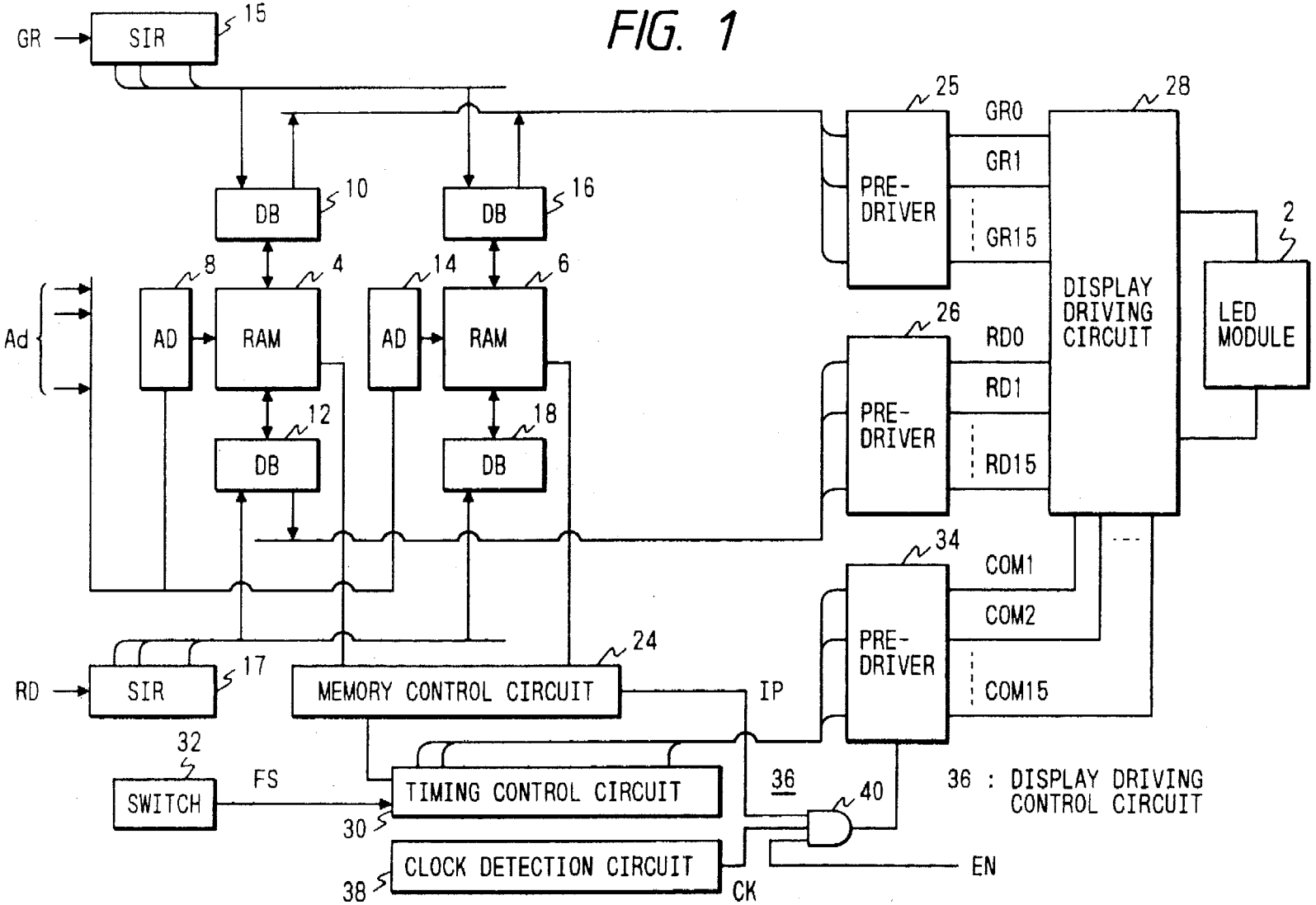
FIG. 1 is a block diagram illustrating an embodiment of the display device according to the present invention.

FIG. 1 shows an embodiment of a display device according to the present invention. In this display device, there is provided an LED module 2 constituted by two color LEDs, for example, LEDs emitting green and red lights respectively, and two random access memories (RAMs) 4 and 6 are provided as storage means for the display data for this LED module 2 to perform color display. An address decoder (AD) 8 and data buffers (DBs) 10 and 12, and an address decoder (AD) 14 and data buffers (DBs) 16 and 18 are provided in parallel for the RAMs 4 and 6 respectively. Address data Ad of the display data to be written or read is supplied to the address decoders 8 and 14 of the RAMs 4 and 6. Green data GR and red data RD are written in or read from the respective RAMs 4 and 6 as display data. The green data GR is written through a shift register (SIR) 15 from the data buffer 10 to the RAM 4, or from the data buffer 16 to the RAM 6, and is read vice versa. The red data RD is written through a shift register (SIR) 17 from the data buffer 12 to the RAM 4, or from the data buffer 18 to the RAM 6, and is read vice versa.

A memory control circuit 24 is provided for the RAMs 4 and 6, as a storage control means for memory control to perform writing and reading the respective green and red data GR and RD alternately, and for generating a display inhibition signal IP for a predetermined period of time from turning-on of a power supply till the time when the display data is made definite.

The green data GR read from the RAMs 4 and 6 are supplied through the data buffers 10 and 16 to a pre-driver 25 acting as a display driving means, and green display signals GR0, GR1, . . . , and GR15 are outputted from this pre-driver 25. On the other hand, the red data RD read from the RAMs 4 and 6 are supplied through the data buffers 12 and 18 to a pre-driver 26 acting as a display driving means, and red display signals RD0, RD1, . . . , and RD15 are outputted from this pre-driver 26. The green display signals GR0, GR1, . . . , and GR15 and the red display signals RD0, RD1, . . . , and RD15 are supplied to a display driving circuit 28 acting as a display driving means for applying a driving current to the LED module 2.

A timing control circuit 30 is provided to act as a common signal generating means for generating common signals COM0, COM1, . . . , and COM15 for the display driving circuit 28, and common signals COM0, COM1, . . . , and COM15 for establishing current conduction sections for the driving currents to LEDs on the basis of a clock signal CLK generated by a not-shown clock generating circuit are formed in this timing control circuit 30. A switch 32 for selecting the frequency of the clock signal CLK is connected to the timing control circuit 30, so that a frequency selection signal FS for changing the frequency of the clock signal CLK is given thereto by this switch 32. In the timing control circuit 30, the common signals COM0, COM1, . . . , COM15 are formed on the basis of the clock signal CLK' having a frequency assigned by the switch 32.

The respective common signals COM0, COM1, . . . , COM15 are supplied to a pre-driver 34 provided to act as a display driving means in a stage before the display driving circuit 28. A display driving control circuit 36 is added to the pre-driver 34 so as to act as a display driving control means for receiving the display inhibition signal IP from the memory control circuit 24, and for stopping, in response thereto, the output of the pre-driver 34 for a predetermined period of time from the turning-on of the power supply till the time when the display data is made definite in order to prevent indefinite data being displayed.

This display driving control circuit 36 is constituted by the memory control circuit 24, a clock detection circuit 38, an AND circuit 40 and the pre-driver 34. The display inhibition signal IP, a clock detection signal CK from the clock detection circuit 38, and a control signal EN are supplied to the AND circuit 40. The clock detection circuit 38 detects the existence of the clock signal CLK in the timing control circuit 30, and outputs a clock detection signal CK of the H level if the clock signal CLK exists normally. The control signal EN is released when display is stopped. That is, the control signal EN is in the H level in a usual display operation. In this embodiment, therefore, when the control signal EN is H, the clock detection signal CK is H, and the display inhibition signal IP is L, the ANDing condition of the AND circuit 40 is invalid, so that the operation of the pre-driver 34 is stopped by the L output of the AND circuit 40, that is, the common signals COM0, COM1, . . . , COM15 are inhibited from passing, so that the operation of the pre-driver 34 is inhibited in a period where the display inhibition signal IP is in the L level, for a predetermined time after turning-on of the power supply.

The green display signals GR0, GR1, . . . , and GR15 from the pre-driver 25, the red display signals RD0, RD1, . . . , and RD15 from the pre-driver 26 and the common signals COM0, COM1, . . . , and COM15 from the pre-driver 34 are supplied to the display driving circuit 28, and a driving current is supplied to the green and red LEDs of the LED module 2 selectively in accordance with the green display signals GR0, GR1, . . . , and GR15, and the common signals COM0, COM1, . . . , and COM15, or the red display signals RD0, RD1, . . . , and RD15 and the common signals COM0, COM1, . . . , and COM15, so that display corresponding to display data is performed.

Figure 2:
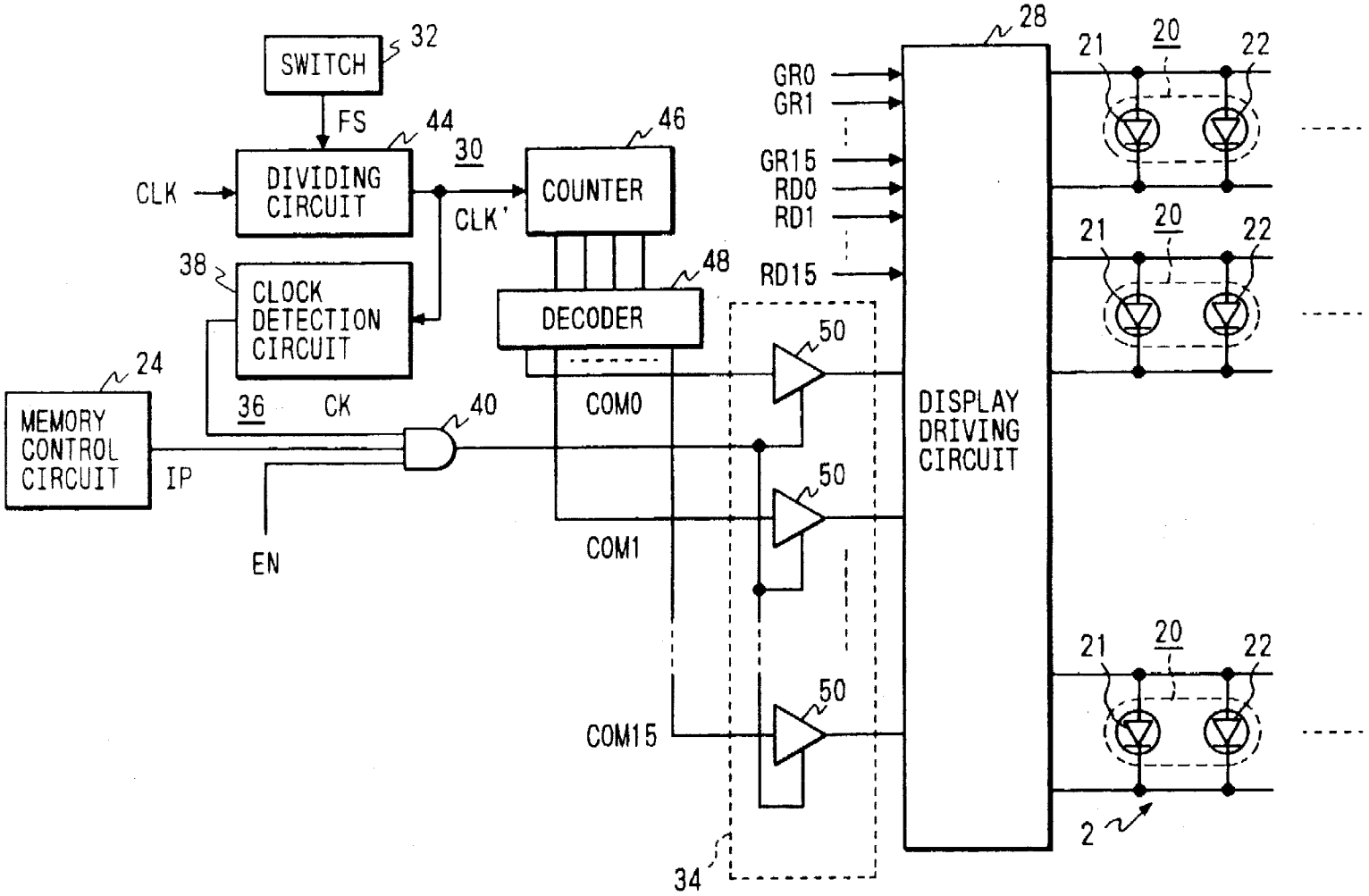
FIG. 2 is a block diagram illustrating a specific embodiment of the display device shown in FIG. 1.

Next, FIG. 2 shows a specific embodiment of the display device shown in FIG. 1. There is provided a dividing circuit 44 for a timing control circuit 30, which is supplied with an external clock signal CLK and divides the clock signal CLK. In this dividing circuit 44, the external clock signal CLK is converted into a clock signal CLK' of a desired frequency. This dividing circuit 44 is arranged so that its dividing ratio can be changed to a desired value from the outside, and a switch 32 is provided as means for changing-over the dividing ratio from the outside. A desired dividing ratio is set in the dividing circuit 44 by operating the switch 32 so that a clock signal CLK' of the frequency corresponding to the dividing ratio can be obtained.

Figure 3:
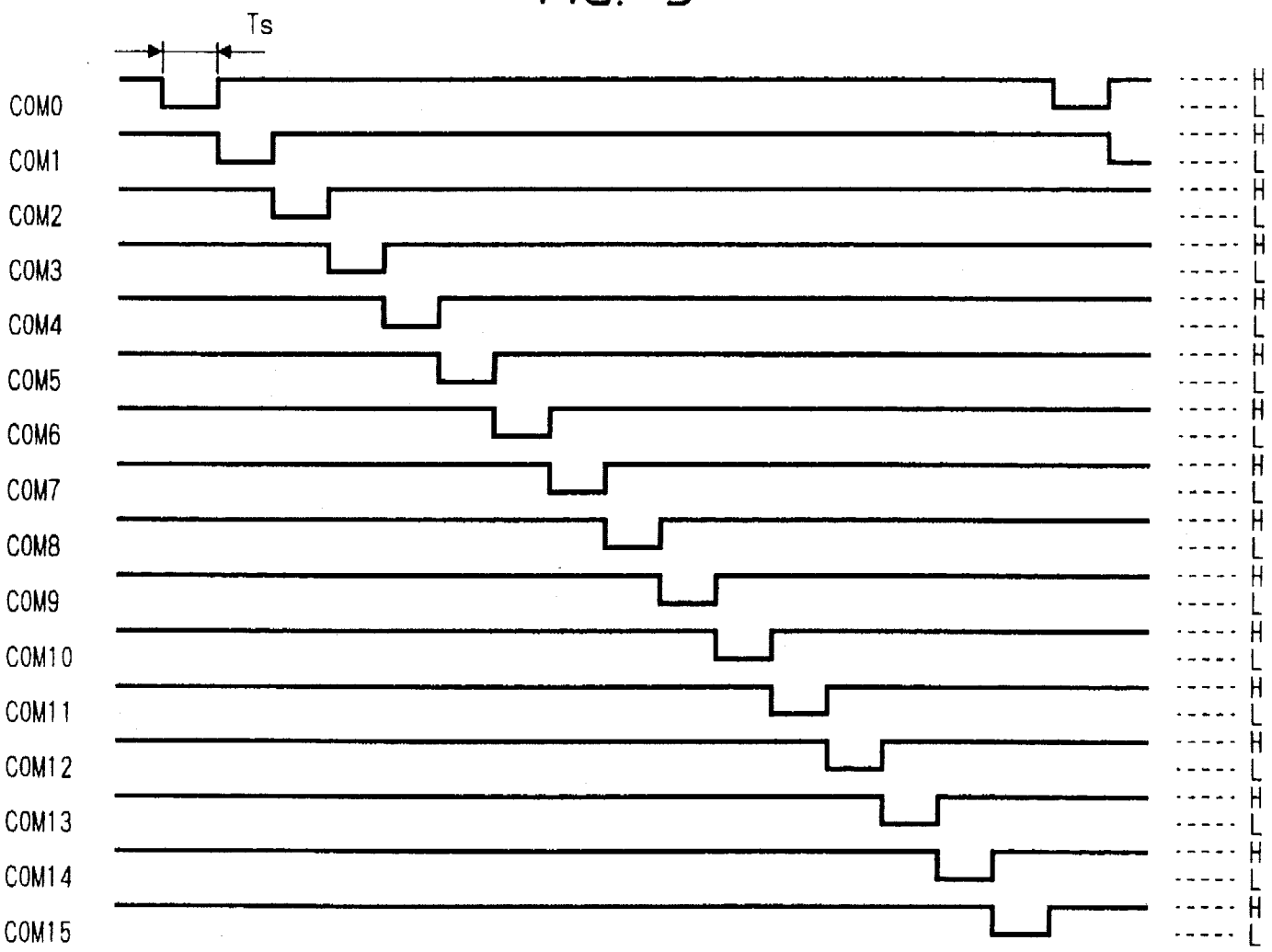
FIG. 3 is a timing chart illustrating common signals used in the display device shown in FIG. 2.

A counter 46 for forming common signals, associated with display elements to be driven, from the clock signal CLK' is provided on the output side of the dividing circuit 44. In this embodiment, a four-bit counter is provided as the counter 46. A decoder 48 for decoding the count value of this counter 46 is provided so that the count value is converted into common signals COM0, COM1, . . . , and COM 15 as 16 kinds of decoded outputs as shown in FIG. 3. An L-level period for a predetermined time Ts is established in each of the common signal COM0, COM1, . . . , and COM15, and this L-level period corresponds to the conduction time of transistors 52 and 54, so that this current conduction period appears repeatedly as long as the common signals COM0, COM1, . . . , and COM15 are continued. The common signal COM0, COM1, . . . , and COM15 are supplied to a pre-driver 34 which is constituted by buffer circuits 50 acting as gate circuits for respectively controlling the passage of the respective common signal COM0, COM1, . . . , and COM15 on the basis of the output of an AND circuit 40. In this embodiment, the respective buffer circuits 50 allows the passage of the common signal COM0, COM1, . . . , and COM15 when the output of the AND circuit 40 is in the H level.

A display driving control circuit 36 is provided on the output side of the dividing circuit 44 so that the display driving control circuit 36 detects transferring of the clock signal CLK into the stop state and makes the common signal COM0, COM1, . . . , and COM15, which is generated by the timing control circuit 30, ineffective to thereby stop the operation of display elements. That is, a clock detection circuit 38 is provided on the output side of the dividing circuit 44 so that the clock detection circuit 38 detects the existence of the clock signal CLK' from the dividing circuit 44 and generates an H-level output as its detection signal when the clock signal CLK' exists. This clock detection circuit 38 may be constituted by, for example, a mono-multivibrator supplied with the clock signal CLK' for generating an H output as a clock detection signal CK when the clock signal CLK' exists.

The clock detection signal CK from the clock detection circuit 38, a display inhibition signal IP from a memory control circuit 24, and a control signal EN are supplied to the AND circuit 40, so that the AND circuit 40 generates an H output when the ANDing condition is valid to thereby make the passage of the common signal COM0, COM1, . . . , and COM15 be permitted in the pre-driver 34.

A plurality of LED pairs 20 respectively constituted by pairs of LEDs 21 and 22, acting as a plurality of display elements or display element pairs, are connected to a display driving circuit 28. In this embodiment, LEDs having emission light of green are used as the LEDs 21, and LEDs having emission light of red are used as the LEDs 22.

Figure 4:
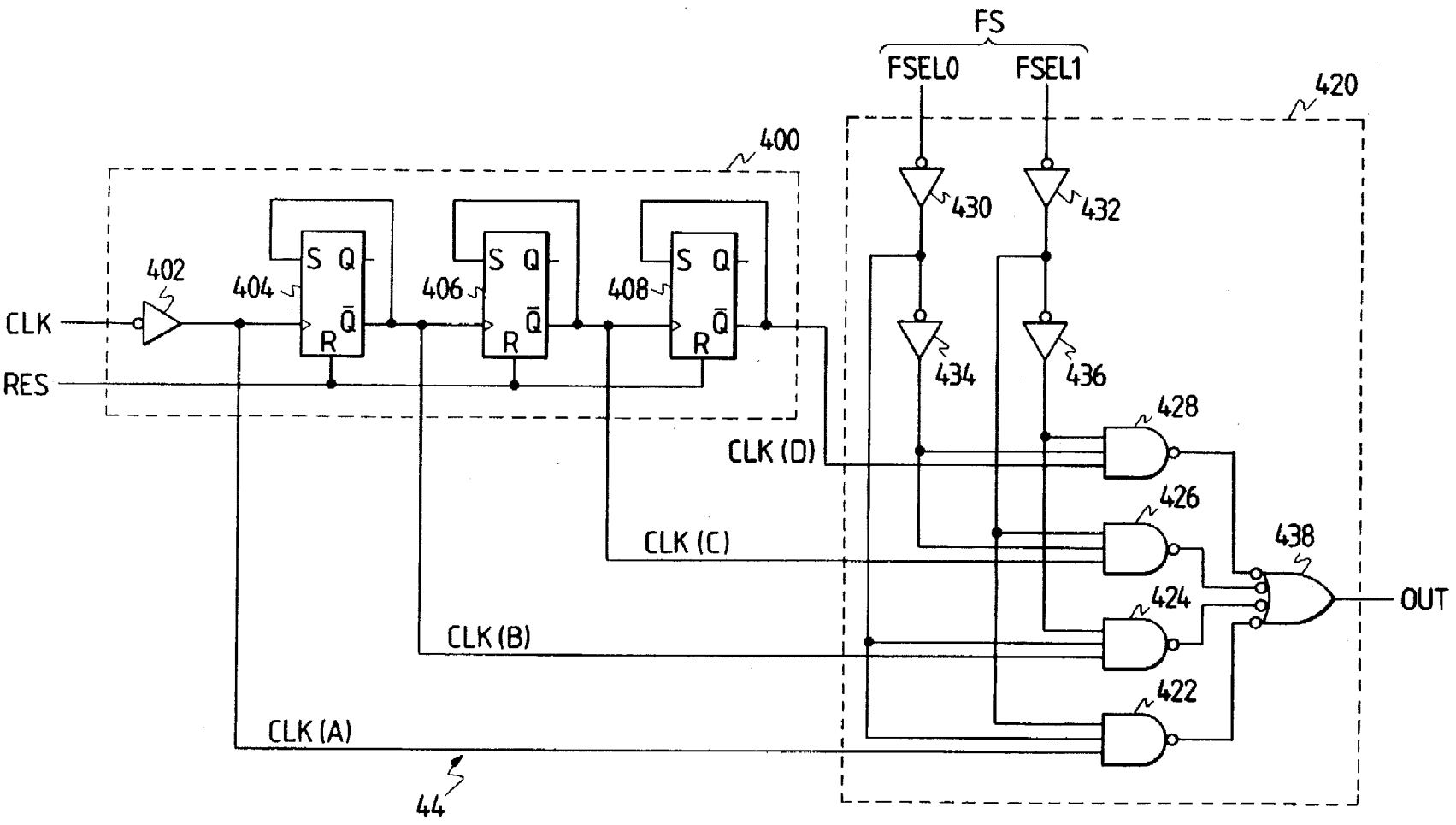
FIG. 4 is a circuit diagram illustrating a specific example of the circuit configuration of the dividing circuit in the display device shown in FIG. 2.

Next, FIG. 4 shows an example of a specific circuit configuration of the dividing circuit 44. A divider 400 for receiving and dividing an external clock signal CLK is provided in this dividing circuit 44, and a decoder 420 is provided in a stage after this divider 400. An invertor 402 and flip flops 404, 406 and 408 connected in series are provided in the divider 400. A common reset signal RES is supplied to reset inputs R of the respective flip flops 404, 406 and 408. A clock signal CLK'(A) of the same frequency A as the input clock signal CLK is extracted from the output side of the invertor 402, a clock signal CLK'(B) of the frequency B (<A) is extracted from the output side of the flip flop 404, a clock signal CLK'(C) of the frequency C (<B) is extracted from the output side of the flip flop 406, and a clock signal CLK'(D) of the frequency D (<C) is extracted from the output side of the flip flop 408.

In the decoder 420, there are provided not only NAND circuits 422, 424, 426 and 428, but also invertors 430, 432, 434 and 436 as gate circuits for setting logical conditions on the basis of a frequency selection signal FS, that is, FSEL0 or FSEL1, from a switch 32 to change over the NANDing conditions of the respective NAND circuits 422 to 428 selectively, and further a NOR circuit 438 for passing the outputs of the respective NAND circuits 422 to 428 is provided on the output side of the respective NAND circuits 422 to 428. That is, the clock signal CLK'(A) of the frequency A from the invertor 402, and the frequency selection signals FSEL0 and FSEL1 respectively inverted by the invertor 430 and 432 are supplied to the NAND circuit 422, and the clock signal CLK'(B) of the frequency B from the flip flop 404, the frequency selection signal FSEL0 inverted by the invertor 430, and the frequency selection signal FSEL1 passed through the invertors 432 and 436 are supplied to the NAND circuit 424. The clock signal CLK'(C) of the frequency C from the flip flop 406, the frequency selection signal FSEL0 inverted by the invertors 430 and 434, and the frequency selection signal FSEL1 passed through the invertor 432 are supplied to the NAND circuit 426, and the clock signal CLK'(D) of the frequency D from the flip flop 408, the frequency selection signal FSEL0 passed through the invertors 430 and 434, and the frequency selection signal FSEL1 passed through the invertors 432 and 436 are supplied to the NAND circuit 428. Consequently, the clock signals CLK' of the different frequencies A, B, C and D are extracted selectively from a constant clock signal CLK on the basis of the frequency selection signal FS. Table 1 shows the relationship among the frequencies A to D in accordance with the frequency selection signals FSEL0 and FSEL1.

TABLE 1

| | | | | |
|---|---|---|---|---|
| FSEL0 | 0 | 0 | 1 | 1 |
| FSEL1 | 0 | 1 | 0 | 1 |
| OUT | A | B | C | D |

Figure 5:
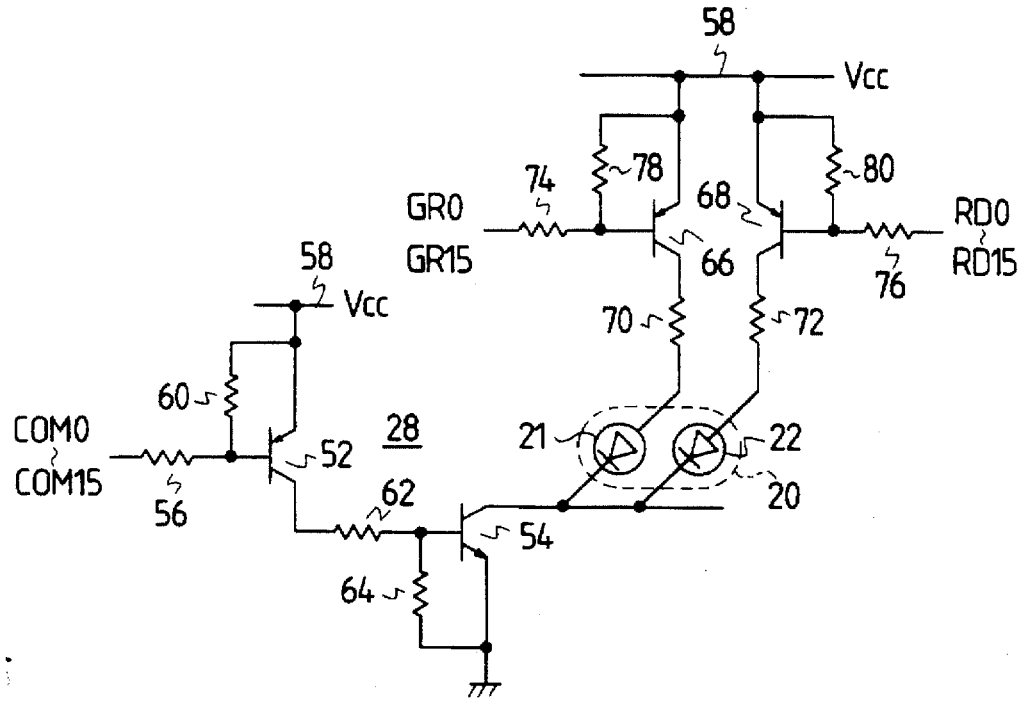
FIG. 5 is a circuit diagram illustrating a specific example of the circuit configuration of the display driving circuit in the display device shown in FIG. 1.

Next, FIG. 5 shows an example of the circuit configuration of the display driving circuit 28. On the cathode side of an LED pair 20 provided as a display element pair, that is, on the ground side, transistors 52 and 54 are provided as first driving elements which are made conductive in response to common signals COM0, COM1, . . . , and COM15. The transistor 52 is constituted by a PNP transistor, and the transistor 54 is constituted by an NPN transistor. A resistor 56 is connected to the base of the transistor 52, and a power supply voltage Vcc supplied to a power supply line 58 is supplied to the base of the transistor 52 through a resistor 60 to thereby set a predetermined bias. Further, the power supply voltage is supplied to the emitter of the transistor 52, and a resistor 62 is connected between the collector of the transistor 52 and the base of the transistor 54. Both the emitter and base of the transistor 54 are grounded directly and through a resistor 64 respectively, and a bias is set in accordance with conduction of the transistor 52.

Further, on the anode side of the LED pair 20 in this display driving circuit 28, transistors 66 and 68 are provided so as to act as second driving elements to be controlled to be conductive in response to a display control signal. That is, a series circuit of the transistor 66 and a resistor 70 is connected between the power supply line 58 and an LED 21, and a series circuit of the transistor 68 and a resistor 72 is connected between the power supply line 58 and an LED 22. Resistors 74 and 76 are connected on the base sides of the transistors 66 and 68 respectively, and predetermined biases are set by resistors 78 and 80. Green display signals GR0, GR1, . . . , and GR15 from a pre-driver 25, and red display signals RD0, RD1, . . . , and RD15 from a pre-driver 26 are supplied to the base of the transistor 66.

Figure 6:
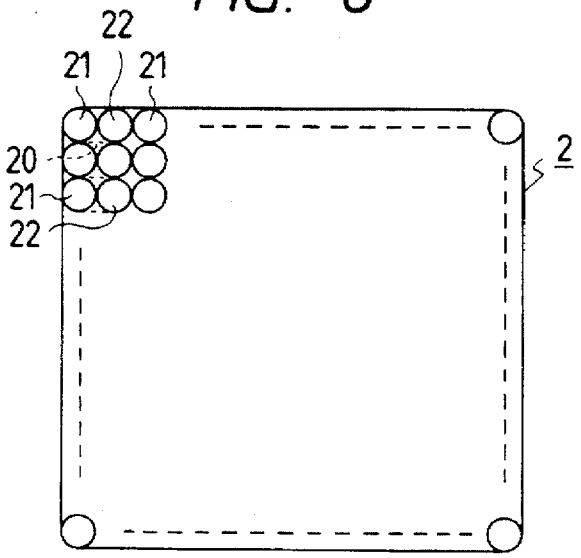
FIG. 6 is a diagram illustrating an LED module in the display device shown in FIG. 1.
Figure 7:
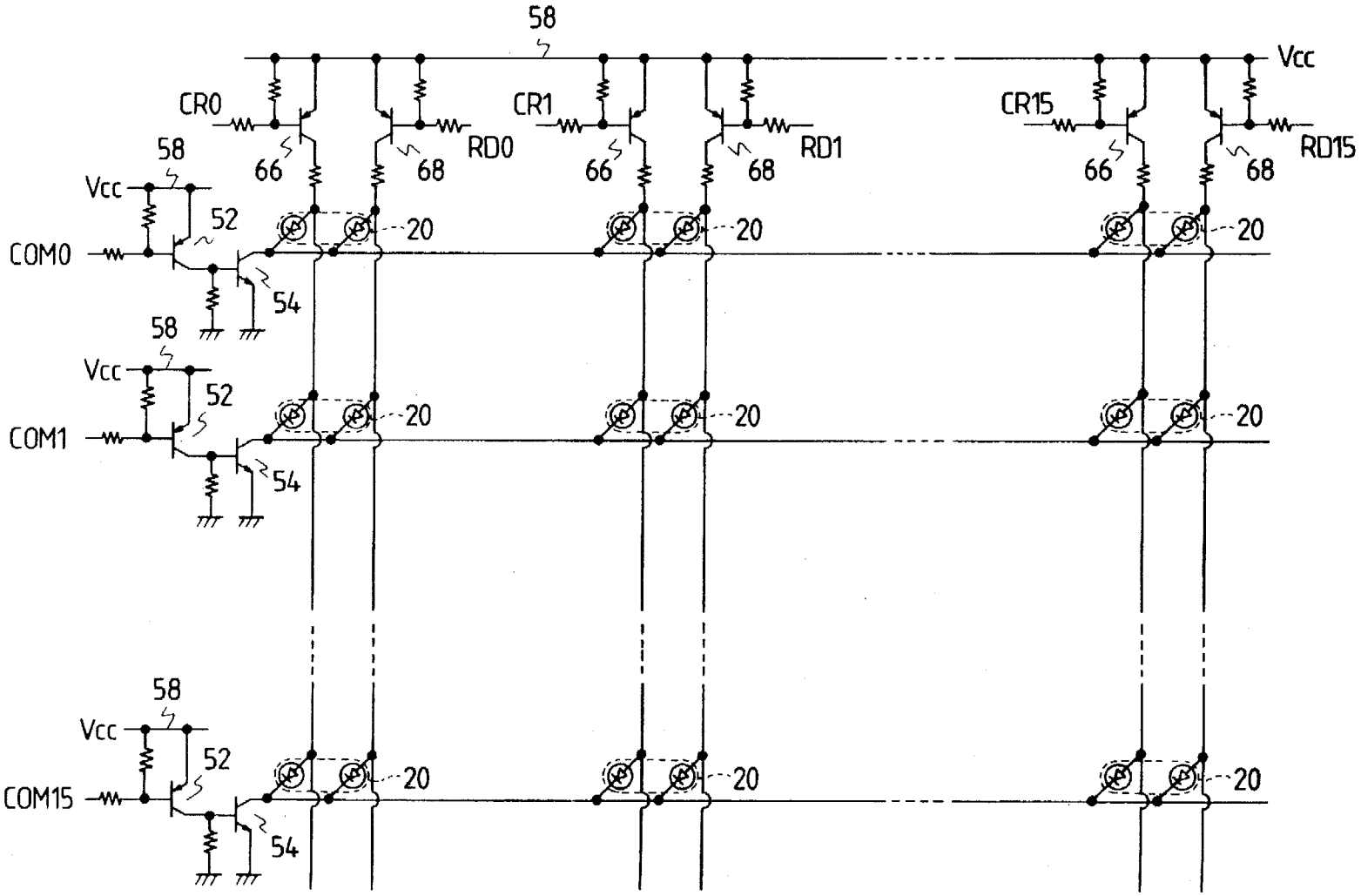
FIG. 7 is a circuit diagram illustrating a display driving circuit and an LED module shown in FIG. 1.

In the case where an LED module 2 including LED pairs 20 in a plurality of rows (m rows) and a plurality of columns (n columns) as a display module as shown in FIG. 6 is driven for every LED pair 20, the LED pairs 20 are grouped for every row and for every column, and the transistors 52 and 54 acting as first driving elements corresponding to the number of the rows, and the transistors 66 and 68 acting as second driving elements corresponding to the number of the columns are provided to apply a driving current selectively. Although one LED pair 20 is constituted by a pair of LEDs 21 and 22 in this embodiment, it may be constituted by a single LED 21 or 22, and then a second driving element is constituted by either the transistor 66 or 68.

Figure 8:
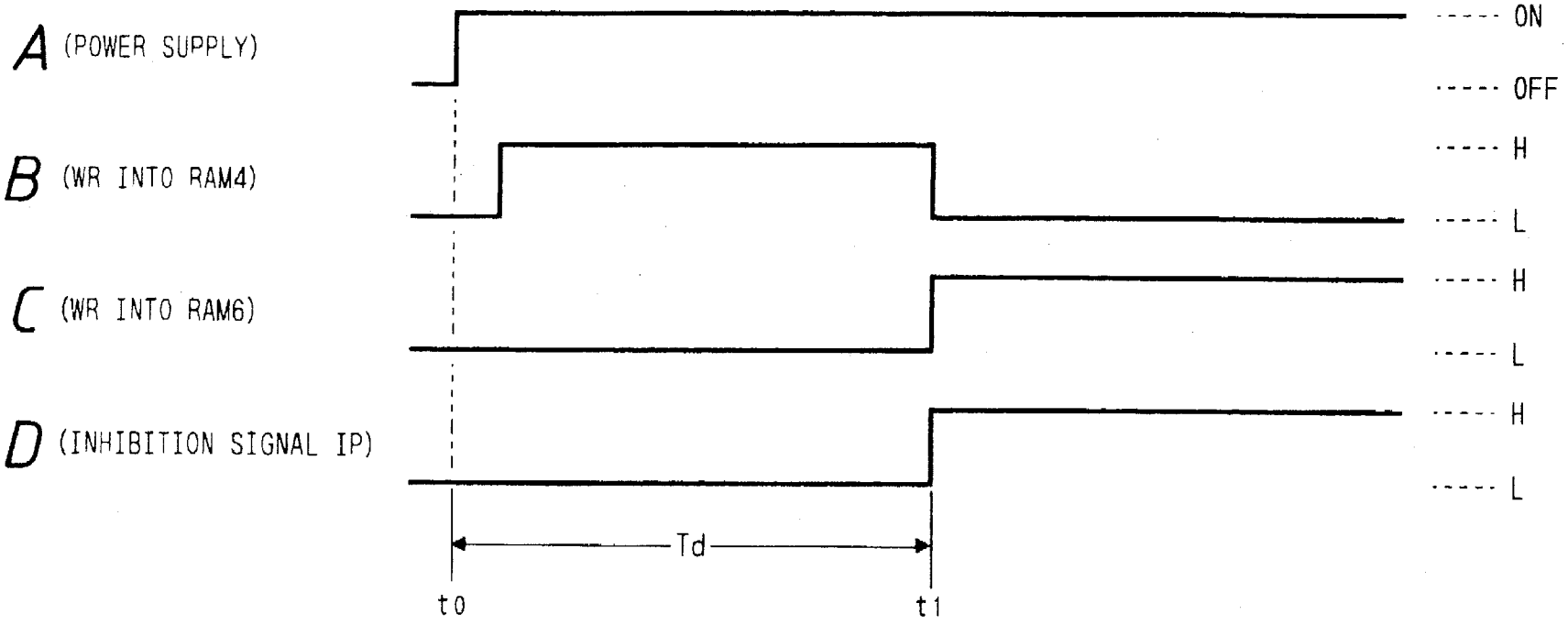
FIG. 8 is a timing chart illustrating the operation of the display device shown in FIG. 1.

The operation of the above configuration will be described. FIG. 8 shows initial data writing at the time of turning-on of a power supply. When the power supply is turned on as shown in A of FIG. 8, the RAMs 4 and 6 are initialized, and data is written into the RAM 4 under the memory control by the memory control circuit 24, for example, in the period of time Td as shown in B of FIG. 8, and after this time Td, data is written into the RAM 6 as shown in C of FIG. 8. Data is written alternately into the RAMs 4 and 6 in a manner so that one of the RAMs 4 and 6 serves to write data while the other is serving to read data.

In this case, the predetermined period of time Td from the point of time $t_0$ of turning-on of the power supply till the point of time $t_1$ when the data of the RAM 4 is made definite represents the time for the initial writing of data into the RAM 4, and the data written in the RAM 4 is made definite at the point of time $t_1$. At this time, the display inhibition signal IP is in the L level for the period of time Td as shown in D of FIG. 8.

This display inhibition signal IP is supplied to the AND circuit 40 in FIGS. 1 and 2, so that the ANDing condition is made invalid while the display inhibition signal IP is kept in the L level, and the output of the AND circuit 40 becomes L. At this time, it is assumed that the clock detection circuit 38 detects a clock signal CLK', in normal operation, to generate an H output, and the control signal EN is in the H level to perform a display operation.

If the AND circuit 40 generates an L output, the buffer circuit 50 of the pre-driver 34 is controlled to be in the state of breaking signals, so that the common signals COM0, COM1, . . . , COM15 are inhibited from passing. Therefore the operations of the transistors 52 and 54 of the display driving circuit 28 are stopped so that a driving current is stopped from being supplied to the LED pairs 20.

If the display inhibition signal IP transfers to the H level so that the AND circuit 40 generates an H output after the period of time Td, the buffer circuit 50 of the pre-driver 34 permits the common signals COM0, COM1, . . . , COM15 to pass, so that the respective transistors 52 and 54 of the display driving circuit 28 are made conductive intermittently sequentially because of the arrival of the respective current conduction periods Ts (shown in FIG. 3) of the common signals COM0, COM1, . . . , COM15, so that a driving current is permitted to be supplied to the LED pairs 20. In such a state, if the green display signals GR0, GR1, . . . , GR15 are outputted from the pre-driver 25, the transistors 66 are made conductive so that a driving current is supplied to the LEDs 21 to turn on the LEDs 21. If the red display signals RD0, RD1, . . . , RD15 are outputted from the pre-driver 26, the transistors 68 are made conductive so that a driving current is supplied to the LEDs 22 to turn on the LEDs 22.

In this display device, therefore, a driving current is inhibited from being supplied to the LED pairs 20 before writing of data is completed in one of the RAMs after turning-on of the power supply, so that it is possible to prevent indefinite display to thereby improve the reliability of display.

Further, if the divider 44 provided in the timing control circuit 30 is constituted, for example, in such a manner as shown in FIG. 4, an external clock signal CLK can be converted into a desired frequency clock signal CLK' in accordance with a frequency selection signal FS to thereby form common signals COM0, COM1, . . . , COM15. Therefore, according to such a configuration, a plurality of counters need not be provided when a plurality of frequencies are required depending on applications, so that it is possible to reduce the circuit scale to thereby reduce the number of gates.

Further, in this display device, in the case where the external clock signal CLK is stopped, a clock detection signal CK of the clock detection circuit 38 transfers to the L level showing the stoppage of the clock signal CLK, so that the output of the AND circuit 40 is made L and the output of the pre-driver 34 is stopped. Thus, even if the common signals COM0, COM1, . . . , COM15 supplied from the decoder 48 are in the H level, the operations of the transistors 52 and 54 are stopped to thereby break a driving current to the LED pairs 20. Therefore, even if the transistors 66 and 68 are made conductive by the arrival of the green display signals GR0, GR1, . . . , GR15 or the red display signals RD0, RD1, . . . , RD15, a driving current is inhibited from being supplied to the respective LED pairs 20, so that it is possible to protect the respective LED pairs 20 from being broken by continuous current conduction of the transistors 52 and 54 caused by the stoppage of the clock signal CLK.

Further, in this display device, the whole circuit excepting the switch 32, the display driving circuit 28 and the LED module 2 in FIG. 1 can be constituted by a single IC, so that it is possible to simplify the display device.

As has been described, according to the present invention, the following effects can be obtained.

a) It is possible to prevent indefinite display at the time of turning-on of a power supply, so that it is possible to improve the reliability of display.

b) It is possible to change the clock frequency from the outside, so that it is possible to prevent the circuit scale from being increased and to reduce the number of gates.

What is claimed is:

1. A display device, comprising:

a plurality of display elements to be driven selectively or simultaneously;

storage means for storing display data to be displayed by said display elements;

a storage control means for generating a display inhibition signal for a predetermined period of time from turning-on of a power supply till said display data of said storage means is made definite; and a display driving control means for breaking supply of a driving current to said display elements when said storage control means is generating said display inhibition signal.

2. A display device as claimed in claim 1, wherein said display driving control means includes a clock detection circuit, an AND circuit and a pre-driver, said clock detection circuit outputting to said AND circuit a clock detection signal indicating presence of a clock signal, said AND circuit receiving said display inhibition signal, said clock detection signal and a control signal indicating whether display operation is performed, and said pre-driver receiving a signal from said AND circuit to control a driving current supplied to said display elements.

3. A display device, comprising:

a plurality of display elements to be driven selectively or simultaneously;

a common signal generating means for generating a plurality of different common signals to establish current conduction periods of driving currents to be supplied to said display elements respectively; and a clock frequency converting means provided in a stage before said common signal generating means and supplied with a clock signal, for converting a frequency of said clock signal in response to an external clock selection signal and for supplying said frequency converted clock signal to said common signal generating means.

4. A display device as claimed in claim 3, wherein said clock frequency converting means includes a divider and a first decoder, said divider receiving said clock signal to produce a plurality of frequency converted clock signals havaing different frequencies from each other, and said first decoder extracting one of said frequency converted clock signals.

5. A display device as claimed in claim 4, wherein said divider is constituted by an inverter and a plurality of flip-flops, and said first decoder is constituted by a gate circuit receiving said external clock selection signal, a plurality of NAND circuits connected to said gate circuit and said divider, and a NOR circuit receiving outputs of said NAND circuit and outputting said one of said frequency converted clock signals.

6. A display device as claimed in claim 4, wherein said common signal generating means includes a counter receiving said extracted one of said frequency converted clock signals, and a second decoder for decording a count value of said couter to produce said common signals corresponding to said one of said frequency converted clock signals.

7. A display device as claimed in claim 3, further including clock selection signal generating means to supply an external clock selection signal to the clock frequency converting means to convert the frequency of the clock signal provided thereby.

* * * * *